US007178575B2

(12) United States Patent
Yu Chen

(10) Patent No.: US 7,178,575 B2
(45) Date of Patent: Feb. 20, 2007

(54) LABEL MAKER

(76) Inventor: Hsiu-Man Yu Chen, No. 27, Sec. 1, Ta Fu Road, Tan Tzu Hsiang, Taichung (TW) 427

( * ) Notice: Subject to any disclaimer, the term of this patent is extended or adjusted under 35 U.S.C. 154(b) by 272 days.

(21) Appl. No.: 10/981,446

(22) Filed: Nov. 5, 2004

(65) Prior Publication Data

US 2006/0096713 A1 May 11, 2006

(51) Int. Cl.
*B44C 7/02* (2006.01)

(52) U.S. Cl. ..... 156/577; 156/574; 156/579

(58) Field of Classification Search ..... 156/523, 156/526, 574, 577, 579
See application file for complete search history.

(56) References Cited

U.S. PATENT DOCUMENTS

RE27,889 E * 1/1974 Sato et al. ..... 156/384
4,473,426 A * 9/1984 Goodwin et al. ..... 156/384
5,181,983 A * 1/1993 Sakai ..... 156/523
5,456,792 A * 10/1995 Rodriguez et al. ..... 156/577
5,988,249 A * 11/1999 Mistyurik et al. ..... 156/384
2004/0194895 A1* 10/2004 Steinberger ..... 156/574
2006/0096714 A1* 5/2006 Chen ..... 156/574

* cited by examiner

*Primary Examiner*—Mark A. Osele
(74) *Attorney, Agent, or Firm*—Troxell Law Office PLLC

(57) ABSTRACT

A label maker includes a housing, a tape-roll wheel holder, a label guide roller unit, a synchronous gear unit, a stripping guide member, a changeover stopper and a press-and-deliver device. After a label-tape roll is fitted on the tape-roll wheel holder, the label paper of the label-tape roll is pulled out and inserted in the label guide roller unit. The label and the separable paper of the label paper can be separated from each other by timely shifting the position of the change-over stopper and then respectively guided to a label guiding outlet and a separable-paper guiding outlet. The label guided out of the label-guiding outlet is pressed and pasted on an article by the label press roller of the label press roller unit. The press-and-deliver lever can be pressed to automatically guide labels out for use.

4 Claims, 9 Drawing Sheets

LABEL MAKER

BACKGROUND OF THE INVENTION

1. Field of the Invention

This invention relates to a label maker, particularly to one simple in structure and able to be operated easily, quickly and smoothly.

2. Description of the Prior Art

A conventional label maker generally includes a main body provided with a tape-roll wheel holder and a label-stripping device. The tape-roll wheel holder is provided for fitting a label-tape roll thereon, and the label-stripping device is able to separate labels from separable paper after the label paper of the label-tape roll is pulled and released. Then, the stripped label is timely pressed and pasted on an article.

However, the conventional label maker is complicated in structure and not easy to be assembled and disassembled. In addition, the label paper of a label-tape roll is not easy to be guided in the label-stripping device, and in course of label stripping the label and guiding it outward, the guided-inward label paper and the stripped separable paper are hard to be moved synchronously; therefore, the separable paper that is not yet guided out may cause clogging, unable to let the label pressed and pasted on an article smoothly. In addition, the conventional label maker is provided with no press member for directly guiding labels out for use, having low efficiency in use.

SUMMARY OF THE INVENTION

The objective of the invention is to offer a label maker including a housing, a tape-roll wheel holder, a label-guiding roller unit, a synchronously gear unit, a stripping guide member, a changeover stopper and a press-and-deliver lever. After a label-tape roll is fitted on the tape-roll wheel holder, the label paper of the label-tape roll is inserted in the label-guiding roller unit to have the label and the separable paper of the label paper separated from each other by timely shifting of the change-over stopper and respectively guided out of a label guiding outlet and a separable paper guiding outlet. Then, the label guided outward is pressed and pasted on an article by the label press roller of the label-guiding roller unit, able to be operated easily, quickly and smoothly. Additionally, the press-and-deliver lever can be pressed inward to automatically guide labels out for use.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
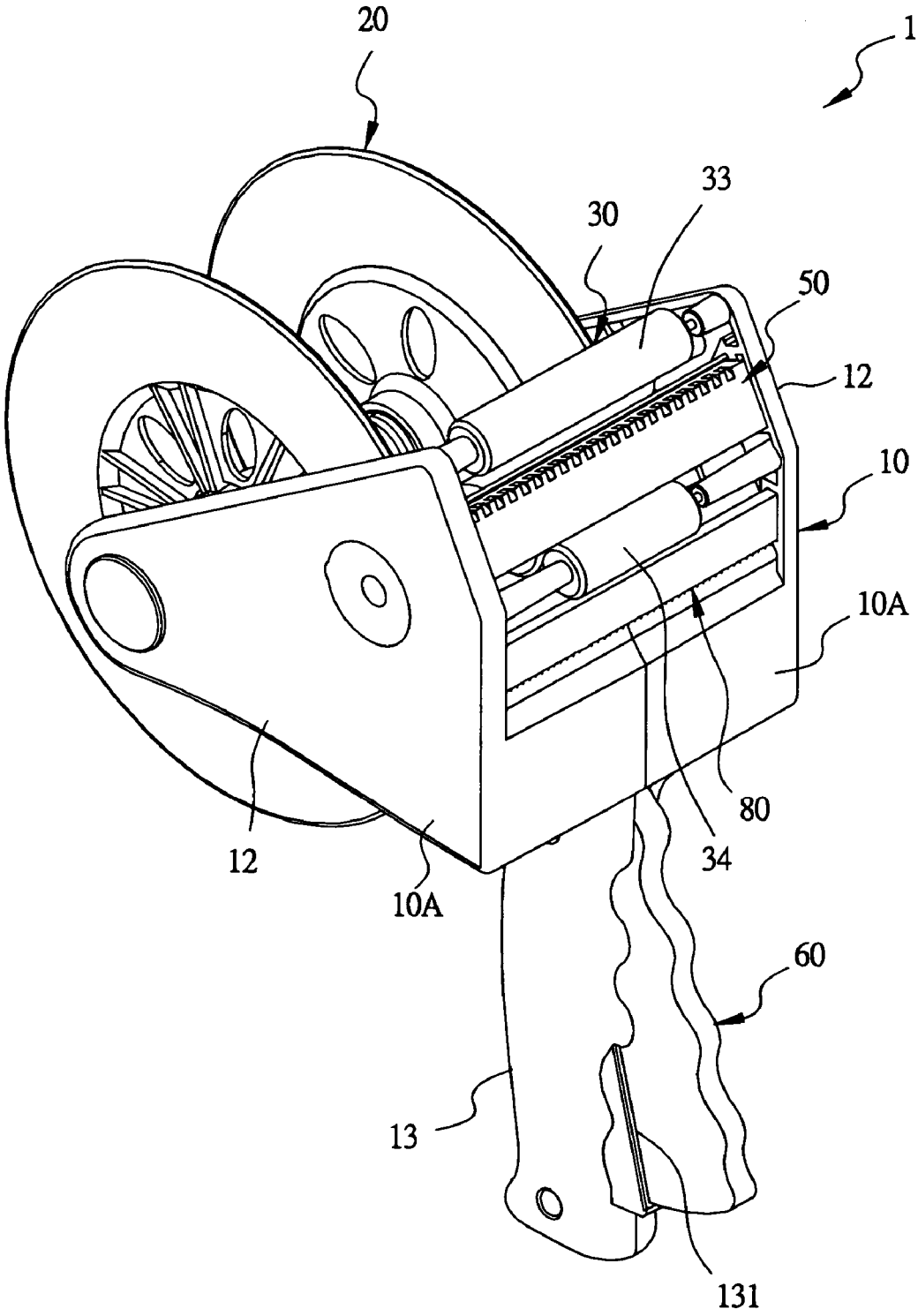
FIG. 1 is a perspective view of a label maker in the present invention.
Figure 2:
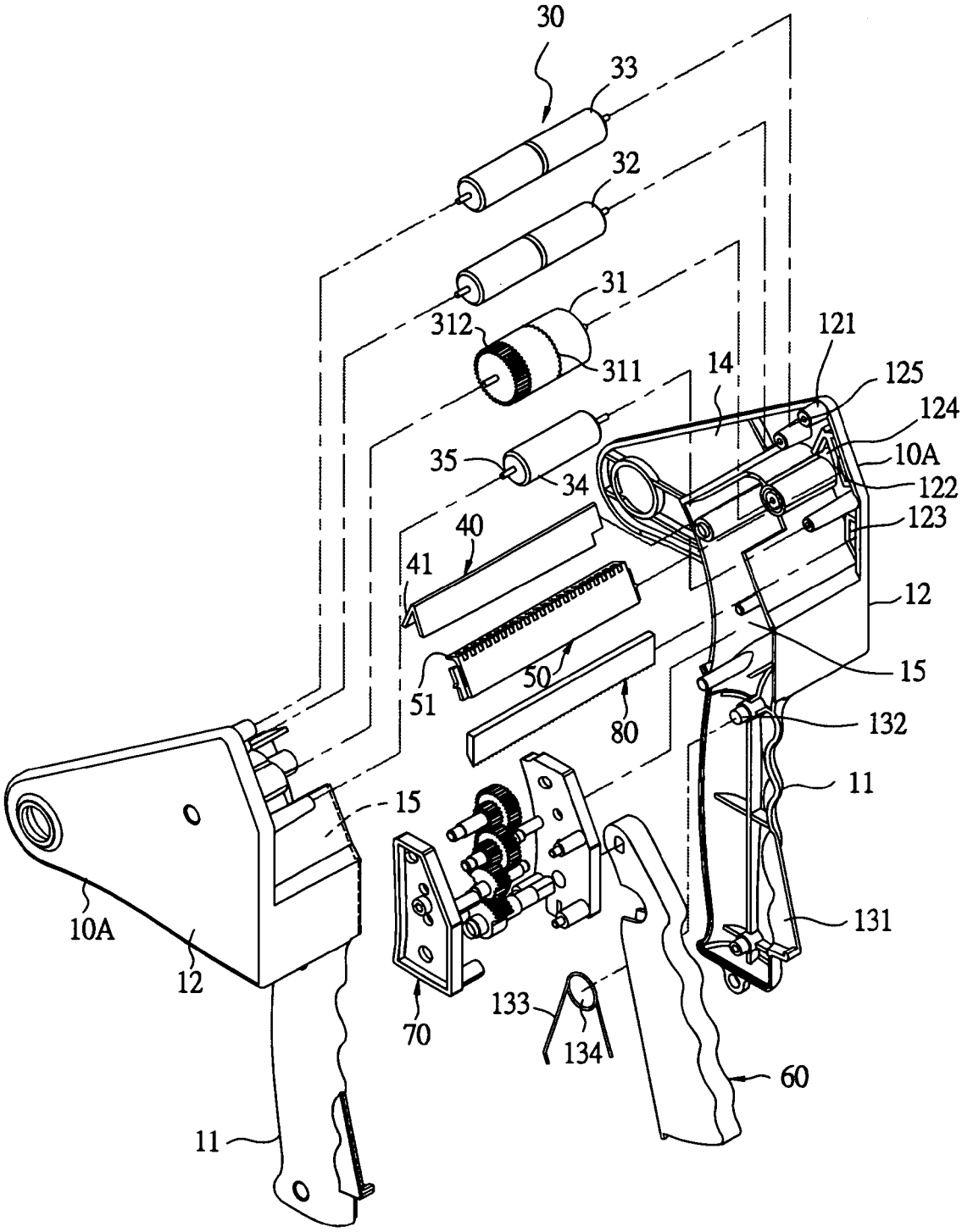
FIG. 2 is a partial exploded perspective view of the label maker in the present invention.
Figure 3:
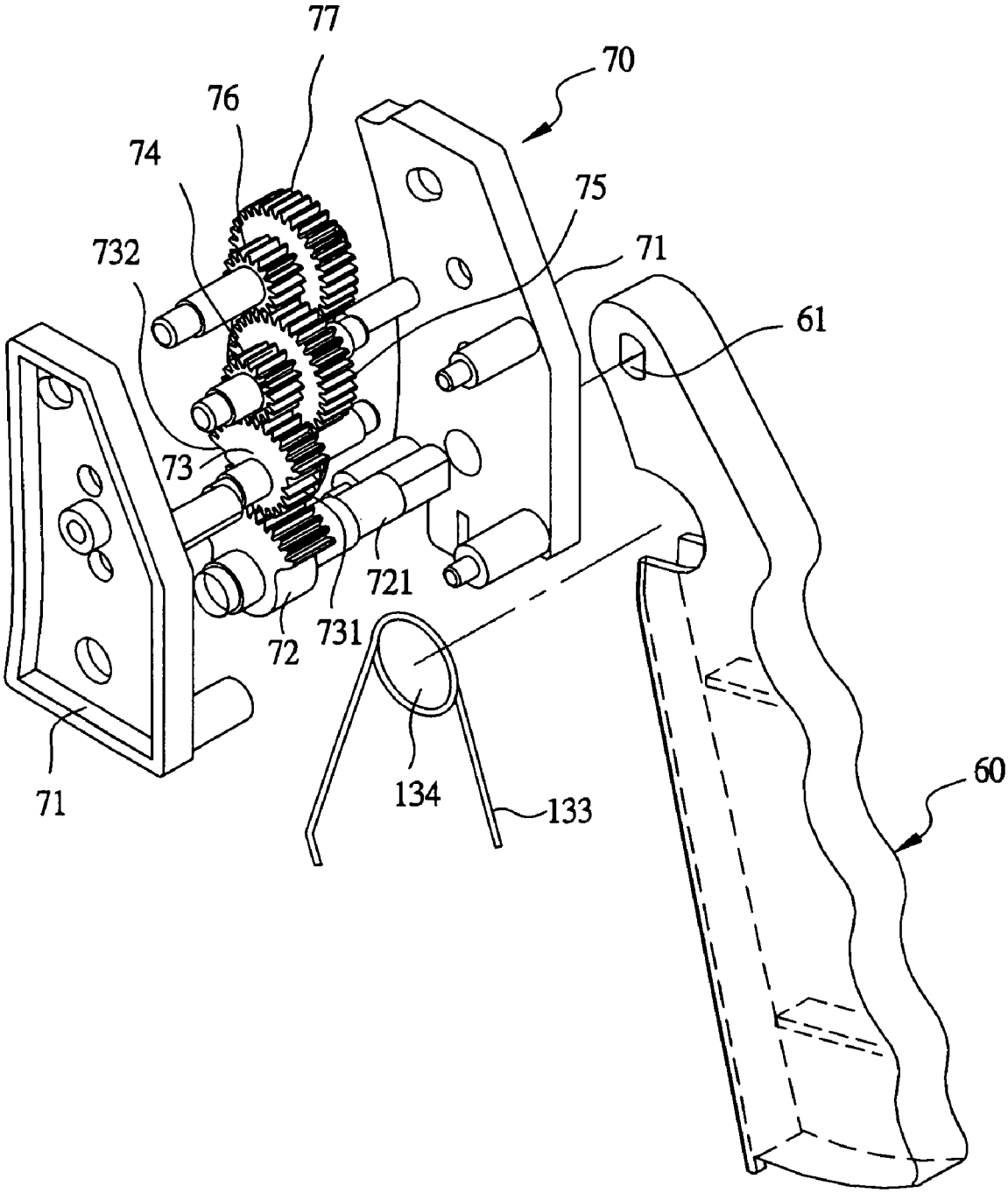
FIG. 3 is an exploded perspective view of the press-and-deliver lever and the transmission gear unit of the label maker in the present invention.
Figure 4:
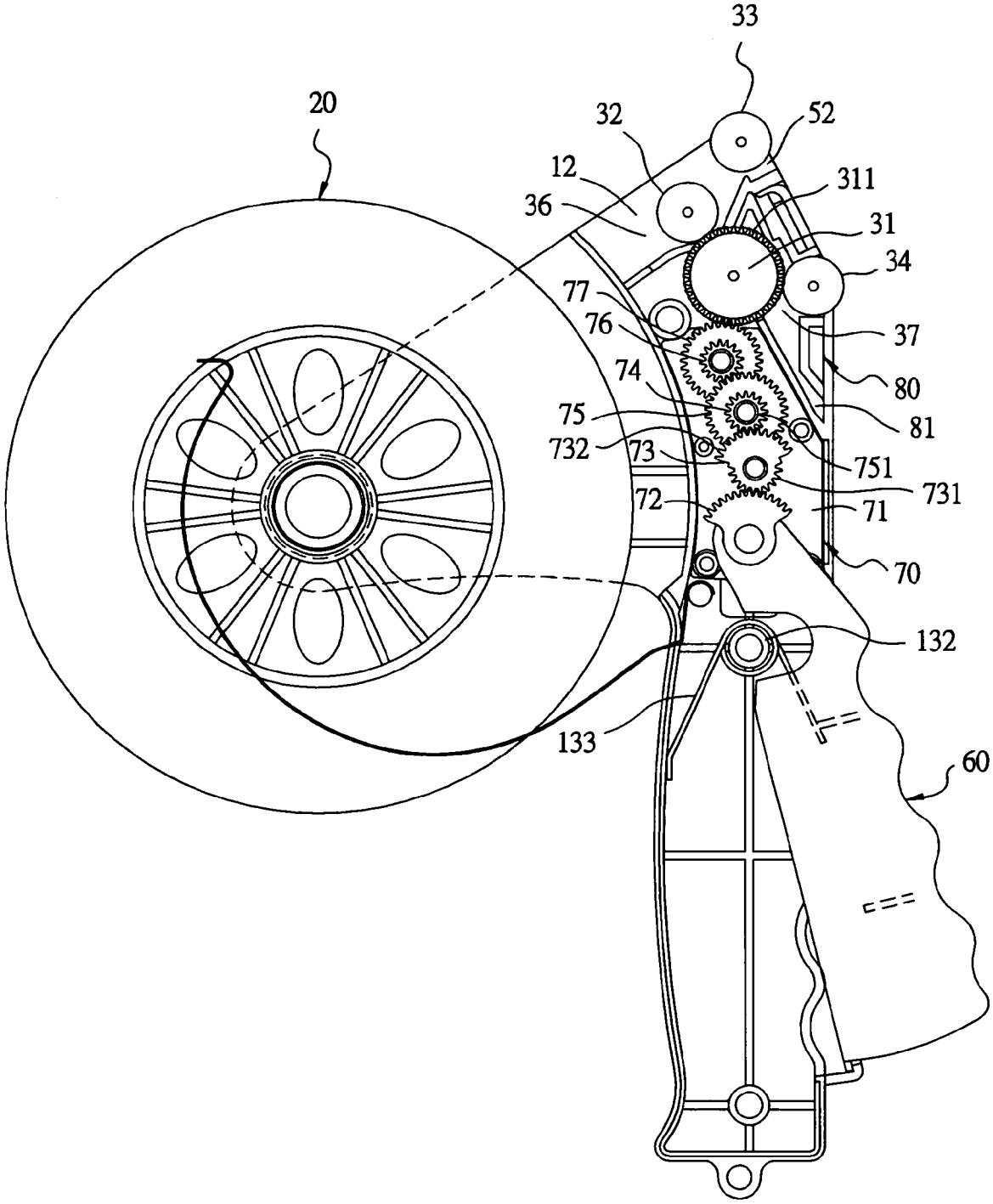
FIG. 4 is a cross-sectional view of the inner structure of the label maker in the present invention.

A preferred embodiment of a label maker in the present invention, as shown in FIGS. 1 to 4, includes a housing 10, a tape-roll wheel holder 20, a label-guiding roller unit 30, a stripping guide member 40, a change-over stopper 50, a press-and-deliver lever 60, a transmission gear unit 70 and a cutter 80 combined together.

The housing 10 consists of two corresponding semi-housings 10A combined together. Each semi-housing 10A is formed with a handle plate 11 and a combining plate 12 extending from the upper end of the handle plate 11. The two handle plates 11 are correspondingly combined together to form a handle 13 having its front side formed with an insert groove 131. The two combining plates 12 are correspondingly combined together and form an accommodating space 14 between them. The two combining plates 12 have their inner sides respectively provided with plural opposed studs 121, a stopper groove 122, a cutter groove 123 and a guide member groove 124 at proper locations, and each stud 121 is bored with a shaft hole 125. Further, the handle 13 is fixed with a transverse shaft 132 in the interior near the upper end for the central hole 134 of an elastic member 133 to be fitted thereon, and the two combining plates 12 are respectively bored with an accommodating groove 15 at a proper location abutting the upper end of the handle 13.

Figure 5:
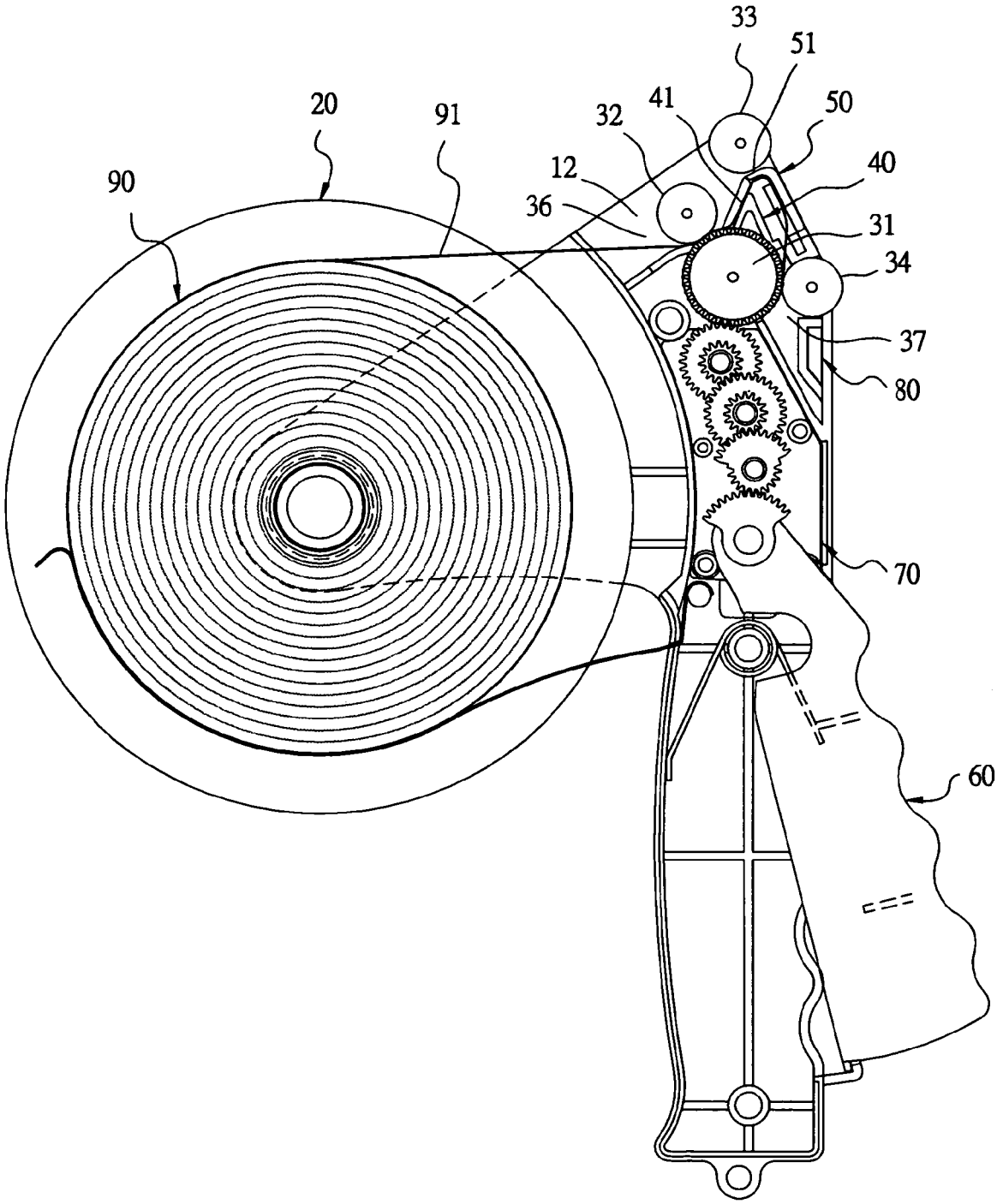
FIG. 5 is a cross-sectional view of the label maker in the present invention, showing that a change-over stopper is moved upward for the label paper pulled and extended outward to be guided inward.

The tape-roll wheel holder 20 is pivotally received in the accommodating space 14 in one end of the two combining plates 12, and the accommodating space 14 is for fitting a label-tape roll 90 therein, located far away from the handle 13, as shown in FIG. 5.

The label-guiding roller unit 30 consists of a connecting roller 31, a front guide roller 32, a label press roller 33 and a separable paper guide roller 34. The separable paper guide roller has its opposite ends respectively fixed with a position shaft 35 to be respectively and correspondingly inserted in the shaft hole 125 of each transverse stud 121 on the inner sides of the two combining plates 12. The connecting roller 31 is provided with annular teeth 311 around the outer circumferential edge of the intermediate portion and a toothed surface 312 around the outer circumferential edge of one end for guiding inward the label paper 91 and actuate it to move forward. The front guide roller 32 and the separable paper guide roller 34 are respectively compressed on a preset portion of the outer circumferential edge of the connecting roller 31, with a guiding inlet 36 formed between the front guide roller 32 and the connecting roller 31 for guiding inward the label paper 91 of the label-tape roll 90 and a guiding outlet 37 formed between the separable-paper guide roller 34 and the connecting roller 31 for guiding the stripped separable paper 911 outward. The label press roller 33 is able to guide, press and paste labels 92 on an article after they are separated from the label paper 91.

The stripping guide member 40 has its opposite ends respectively inserting in the opposite guide member grooves 124 of the two combining plates 12, positioned near a label guiding outlet between the connecting roller 31 and the front guide roller 32 and formed with a stripping slope 41. After guided out by both the connecting roller 31 and the front guide roller 32, the label paper 91 is guided to move forward along the stripping slope 41 of the stripping guide member 40 and has its label 912 and separable paper 911 separated from each other.

The change-over stopper 50 has its opposite ends respectively and slidably positioned in the opposite stopper grooves 122 in the inner sides of the two combining plates 12, and its opposite sides are able to be respectively moved toward the label press roller 33 and the separable-paper guide roller 34. The changeover stopper 50 is provided with a stop edge 51 at one side opposed to the label press roller 33. When the changeover stopper 50 is moved to the label press roller 33, its stop edge 51 can exactly guide the end of the separable paper 911 that is just guided inward and stripped by the stripping guide member 40, to move to a separable-paper guiding outlet 37. When the separable paper 911 is properly guided out, the change-over stopper 50 can be moved toward the separable-paper guide roller 34 to allow the label 912 stripped by the stripping guide member 40 to be guided out of the label guiding outlet 52 formed between the label press roller 33 and the change-over stopper 50, and then the labels 912 guided out orderly are pressed and pasted on articles.

The press-and-deliver lever 60 extends out from the front side of the handle 13 of the housing 10, having one end bored with a non-circular insert hole 61. The press-and deliver level 60 has its inner side pushed outward by the V-shaped elastic member 133 fitted in the handle 13 and can recover its original position automatically after it is pressed inward.

The transmission gear unit 70 consists two side covers 71, a force input gear 72, a first gear 73, a second gear 74, a third gear 75, a fourth gear 76 and an output gear 77, which are all received in the accommodating groove 15 formed in the combining plates 12 opposed to one side with the toothed surface 312 of the connecting roller 31. The input gear 72 axially installed between the two side covers 71 is a sector toothed block, having a central pivot 721 properly extending outward from one side cover 71 and engaged with the engage hole 61 at the upper end of the press-and-deliver lever 60, letting the input gear 72 actuated by the engage hole 61 of the press-and-deliver lever 60 to rotate for a preset angle. The first gear 73 is formed with a semi-circular toothed portion 731 meshed with the input gear 72 and a sector toothed portion 732 meshed with the second gear 74. The second and the third gear 74, 75 are coaxial gears, fitted on a one-way bearing 751 to be actuated to rotate in one direction only. The fourth gear 76 and the force output gear 77 are coaxial gears, and the output gear 77 is meshed with the toothed surface 312 of the connecting roller 31. Thus, when the press-and-deliver lever 60 is pressed inward, the input gear 72 will be actuated to rotate together with the first, the second, the third, the fourth and the output gears 73, 74, 75, 76 and 77. Simultaneously, the output gear 77 that is meshed with the connecting roller 31 of the label guide wheel unit 30 actuates the connecting roller 31 to rotate for a preset angle to have the label 912 of the guided-inward label paper 91 stripped and delivered outward.

The cutter 80 has its opposite ends respectively engaged with the opposite cutter fitting grooves 123 of the two combining plates 12 of the housing 10. The cutter 80 is positioned near the separable paper guiding outlet 37, with a separable paper final outlet 80 formed between the cutter 80 and the housing 10 for the stripped separable paper 911 to move out therethrough and be cut off by the cutter 80.

Figure 6:
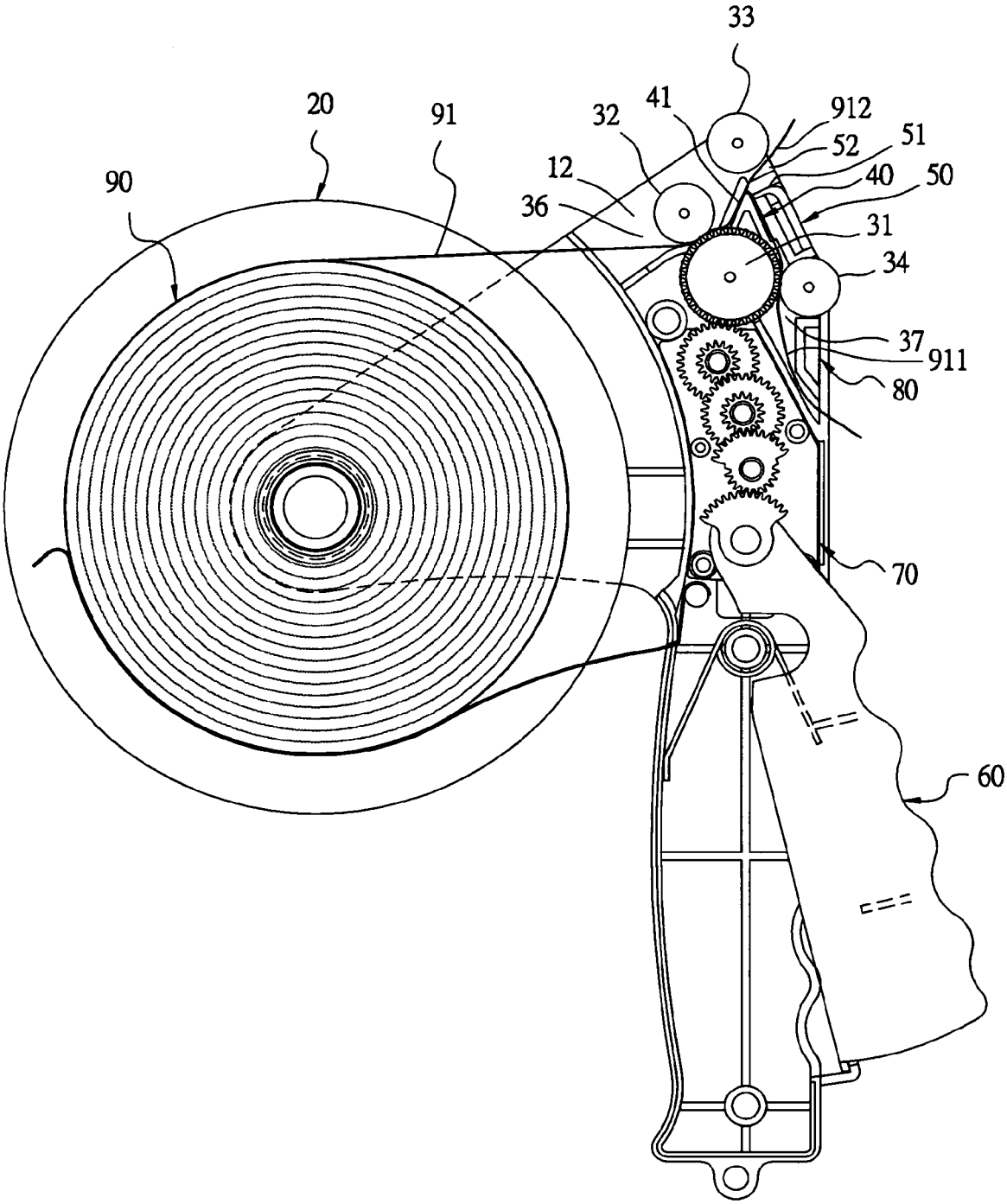
FIG. 6 is a cross-sectional view of the label maker in the present invention, showing that the change-over stopper is moved downward for the label o the label paper to be stripped and having a part of it guided outward.
Figure 7:
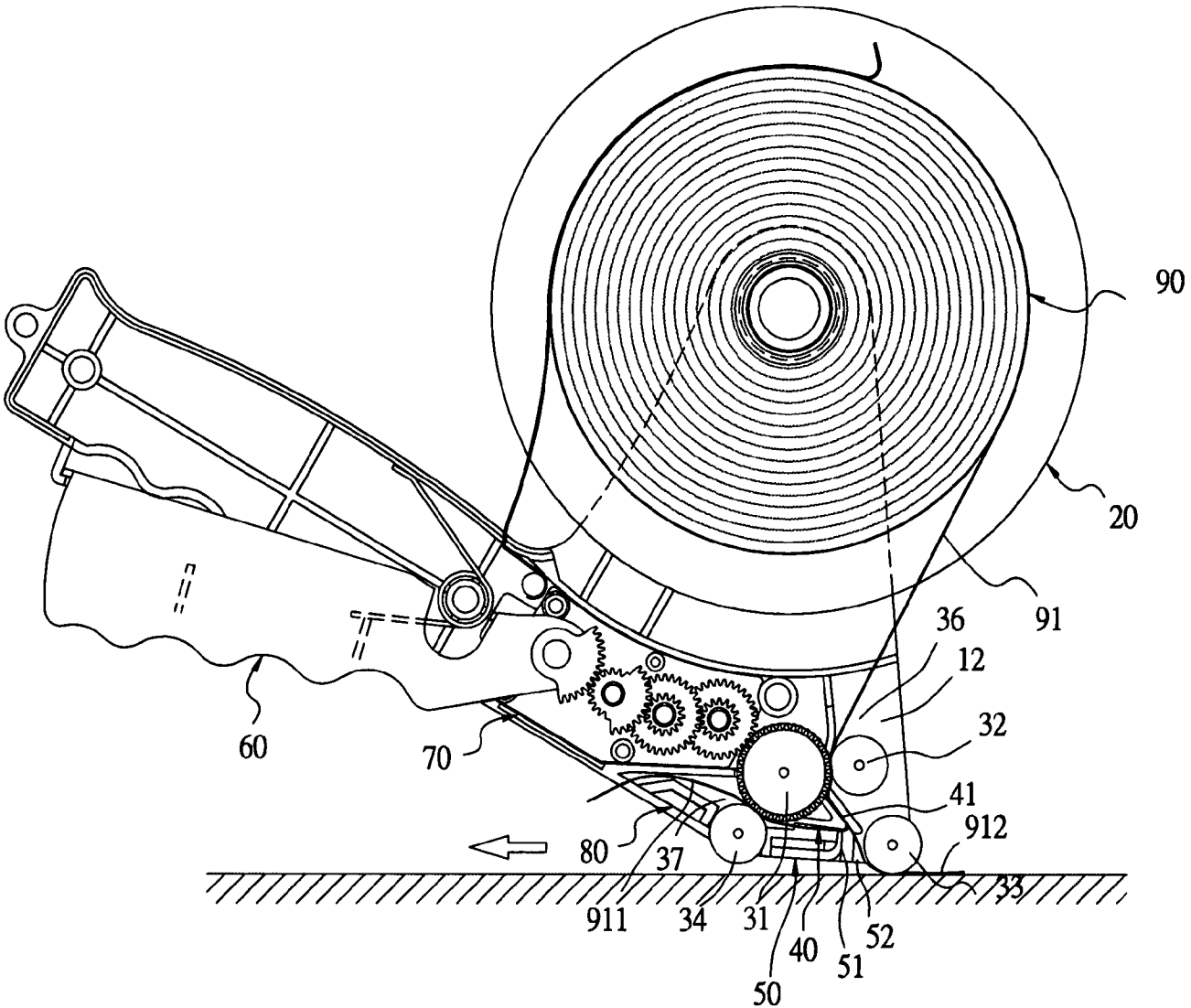
FIG. 7 is a cross-sectional view of the label maker in the present invention, showing that the label guided out is pressed and pasted on the surface of an article.
Figure 8:
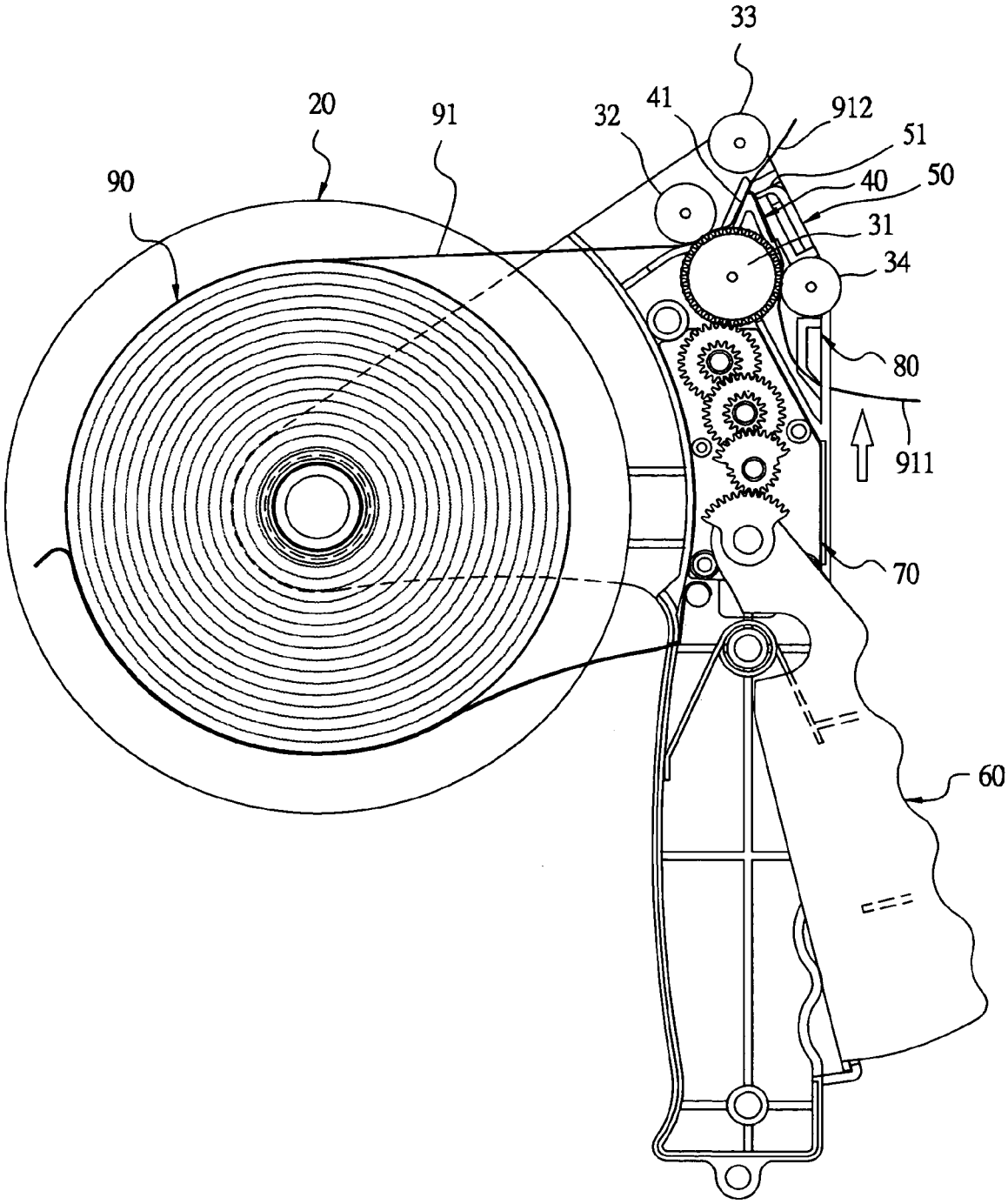
FIG. 8 is a cross-sectional view of the label maker in the present invention, showing that the separable paper guided out is cut and torn off.

In using, as shown in FIG. 5, firstly, the change-over stopper 50 is pulled upward and positioned near the front guide roller 32 and the label paper 91 is pulled outward and has its outer end inserted in the guiding inlet 36 and gripped by both the connecting roller 31 and the front guide roller 32. Then, the front guide roller 32 is properly turned to let the label paper 91 moved forward along the stripping slope 41 of the stripping guide member 40. When the end of the label paper 91 touches the inner wall of the stopping edge 51 at the upper end of the change-over stopper 50, it is blocked by the stopping edge 51 and instantly guided downward along the back side of the change-over stopper 50 and moved in between the connecting roller 31 and the separable-paper guide roller 34 to be gripped. At this time, as shown in FIG. 6, the change-over stopper 50 is pulled downward to be positioned near the separable-paper guide roller 34 to form the label guiding outlet 52 between the stopping edge 51 of the change-over stopper 50 and the label press roller 33, letting the label 912, which is automatically separated from the label paper 91, aligned to the label guiding outlet 52. Thus, when a user holds the label maker 1 and has the separable-paper roller 34 compressed on the surface of an article and has its pressing portion moved a little toward the label press wheel 33, the separable paper 911 will be pulled outward by both the connecting roller 31 and the separable-paper guide roller 34 moved to the separable-paper final outlet 81 beneath the cutter 80. Simultaneously, the label 912 separated from the label paper 91 is smoothly guided out of the label guiding outlet 52 and instantly pressed and pasted on the surface of articles by the label press roller 33 to finish label pasting work, as shown in FIG. 7. In case the separable paper 911 guided out is too long, the outer portion of the separable paper 911 can easily be cut off by the cutter 80 and torn away, as shown in FIG. 8.

Figure 9:
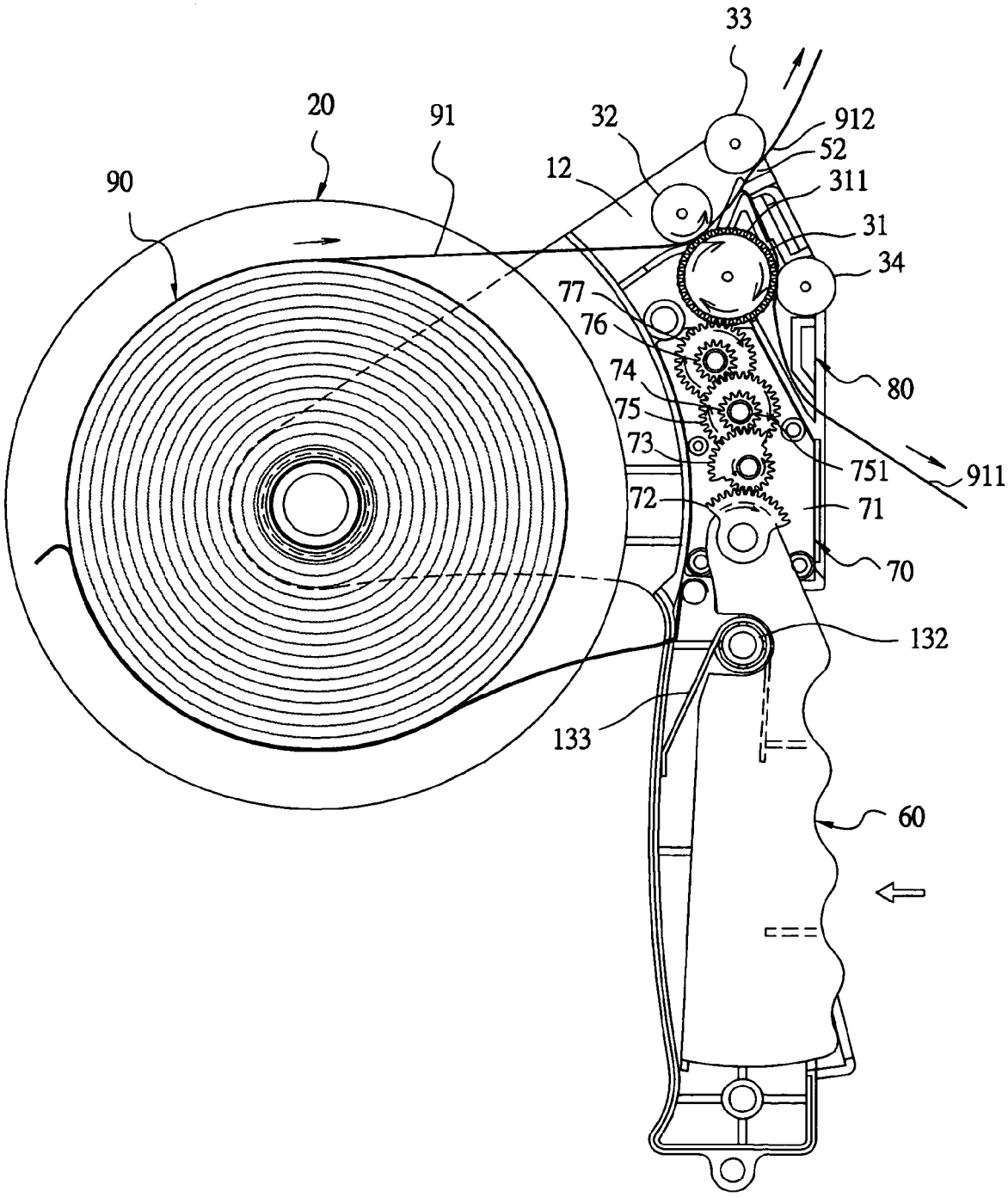
FIG. 9 is a cross-sectional view of the label maker in the present invention, showing that the press-and-deliver lever is pressed inward to guide out the labels.

If a user wants to directly get the labels 912 for use, as shown in FIG. 9, the press-and-deliver lever 60 is pressed inward to indirectly actuate the connecting roller 31 of the label guide roller unit 30 to rotate for a preset angle through the input gear 72 and the first, the second, the third and the fourth gears 73, 74, 75, 76 as well as the output gear 77. Since the annular teeth 311 of the connecting roller 31 is meshed with the front roller 32 and the separable-paper guide roller 3, therefore, when they are rotated synchronously, the separable paper 911 separated from the label paper 91 can be guided out of the separable paper final outlet 81 under the cutter 80 through the separable-paper guiding outlet 37. At the same time, the label 912 separated from the label paper 91 can be guided out for use through the label-guiding outlet 52. When the press-and-deliver lever 60 is released, it will automatically recover to its original position by the elastic member 133 positioned in the housing 10, and when moved back to its original position, the press-and-deliver lever 60 will not actuate the label guide roller unit 30 to move by the function of the one-way bearing 751 of the third gear 75.

While the preferred embodiment of the invention has been described above, it will be recognized and understood that various modifications may be made therein and the appended claims are intended to cover all such modifications that may fall within the spirit and scope of the invention.

I claim:

1. A label maker comprising:

A housing;

A roll wheel holder pivotally assembled at a proper position of said housing, said roll wheel holder provided for fitting a label-tape roll thereon;

A label guide roller unit comprising a connecting roller, a front guide roller, a label press roller and a separable-paper guide roller, which are respectively and axially installed at a proper location of said housing, said front roller and said separable-paper guide roller respectively compressed on a preset portion of the outer circumferential edge of said connecting roller, a separable-paper guiding inlet formed between said front guide roller and said connecting roller for guiding inward the label paper of said label roll, a separable-paper guiding outlet formed between said separable-paper guide roller and said connecting roller for guiding outward separable paper after said separable paper is separated from said label paper, said label press roller provided for guiding, pressing and pasting labels on articles after said label is separated from said label paper;

A stripping guide member fitted at a proper location in said housing, said stripping guide member positioned at a guiding outlet between said connecting roller and said front guide roller, said stripping guide member formed with a stripping slope for guiding and stripping said label paper guided out by said connecting roller and said front guide roller; and A change-over stopper slidably fitted at a proper location in said housing, the opposite sides of said change-over stopper respectively able to slide toward said label press roller and said separable-paper guide roller, said change-over stopper formed with a stopping edge at one end facing said label press roller, said stopping edge of said change-over stopper able to guide the end of said separable paper that is just guided in and stripped to move to said separable-paper guiding outlet when said change-over stopper is shifted toward said label press roller, said stopping edge of said change-over stopper also able to guide said label separated from said label paper to move out of a label guiding outlet when said change-over stopper is shift toward said separable-paper guide roller, said label then pressed and pasted on an article by said label press roller.

2. The label maker as claimed in claim 1, wherein said housing has two corresponding semi-housings combined together and each semi-housing is formed with a handle plate and a combining plate extending outward from the upper end of said handle plate, said two handle plates correspondingly combined together to form a handle, said two combining plates combined together to form an accommodating space in the interior.

3. The label maker as claimed in claim 2, wherein said connecting roller, said front roller, said label press roller and said separable-paper guide roller of said label guide roller unit have their opposite ends respectively fixed with a position shaft, and said two semi-housings have their inner walls respectively and correspondingly secured with studs, each said stud bored with a shaft hole for said position shaft to be axially inserted therein.

4. The label maker as claimed in claim 2, wherein a press-and-deliver lever is pivotally assembled with said handle and an elastic member is fitted in said housing to push against said press-and-deliver lever, said elastic member enabling said press-and-deliver lever to recover its original position after said press-and-deliver lever is pressed inward, said press-and-deliver lever indirectly meshed with said connecting roller of said label guide roller unit by means of a transmission gear unit installed in the interior of said housing, said label and said separable paper of said label paper able to be automatically separated from each other and delivered out when said press-and-deliver lever is pressed inward.

* * * * *